US007733017B2

(12) United States Patent
Shapiro et al.

(10) Patent No.: US 7,733,017 B2
(45) Date of Patent: Jun. 8, 2010

(54) DISPLAY APPARATUS WITH REPLACEABLE ELECTROLUMINESCENT ELEMENT

(76) Inventors: Peysakh Shapiro, 6934 Roundtree St., Shawnee, KS (US) 66226; Sabina Shapiro, 6934 Roundtree St., Shawnee, KS (US) 66226; John R. Shapiro, 6934 Roundtree St., Shawnee, KS (US) 66226; Amenda D. Shapiro, 6934 Roundtree St., Shawnee, KS (US) 66226

( * ) Notice: Subject to any disclaimer, the term of this patent is extended or adjusted under 35 U.S.C. 154(b) by 770 days.

(21) Appl. No.: 11/483,207

(22) Filed: Jul. 7, 2006

(65) Prior Publication Data

US 2007/0007892 A1 Jan. 11, 2007

Related U.S. Application Data

(60) Provisional application No. 60/697,297, filed on Jul. 8, 2005.

(51) Int. Cl.
*H05B 33/04* (2006.01)
*H05B 33/10* (2006.01)

(52) U.S. Cl. ..... 313/511; 313/506; 313/512

(58) Field of Classification Search ..... 445/1, 445/2, 3; 313/498–512
See application file for complete search history.

(56) References Cited

U.S. PATENT DOCUMENTS 1,927,838 A * 9/1933 Kislinger ..... 368/285
2,535,543 A * 12/1950 Maizlish et al. ..... 368/27
2,918,216 A * 12/1959 Shapiro ..... 377/10
3,091,876 A * 6/1963 Cole ..... 40/452
3,673,450 A * 6/1972 Leach ..... 313/506
4,089,045 A * 5/1978 Mars ..... 362/390
4,143,297 A * 3/1979 Fischer ..... 313/502
4,287,676 A * 9/1981 Weinhaus ..... 40/661.01
4,508,990 A * 4/1985 Essinger ..... 313/50
4,775,964 A * 10/1988 Alessio et al. ..... 368/67
4,810,937 A * 3/1989 Havel ..... 315/152
5,019,748 A 5/1991 Appelberg
5,045,755 A 9/1991 Appelberg
5,289,171 A * 2/1994 Nire et al. ..... 345/76

(Continued)

OTHER PUBLICATIONS

Labguy's World: 1974 Sony DXC-1600 Trinicon Tube Hand Held Color Camera, Jan. 6, 2005.*

(Continued)

*Primary Examiner*—Nimeshkumar D Patel
*Assistant Examiner*—Steven Horikoshi
(74) *Attorney, Agent, or Firm*—John C. McMahon

(57) ABSTRACT

An electroluminescent apparatus utilizes a replaceable electroluminescent element which is compressed between two electrodes that are positioned within a resealable housing which may be opened and closed so that a used electroluminescent element may be removed from between the electrodes and replaced at the end of its usable lifetime. The housing has front and rear panels associated with the respective electrodes, at least one of the panels being transparent. The apparatus may include an inflatable compressing structure, an alignment structure within the housing for alignment of the electroluminescent sheet, or transparent electrodes, and various drivers may be used allowing for monochrome or color displays. The housing may have an envelope configuration, or the electroluminescent element can have a configuration of a roll of sequential electroluminescent sheets or a tiled structure allowing for larger electroluminescent displays, within the scope of the present invention.

22 Claims, 14 Drawing Sheets

U.S. PATENT DOCUMENTS 5,471,773 A * 12/1995 Hoffman ..... 40/544
5,491,377 A 2/1996 Janusauskas
5,533,289 A * 7/1996 Hoffman ..... 40/544
5,830,028 A 11/1998 Zovko et al.
5,895,692 A * 4/1999 Shirasaki et al. ..... 427/557
5,978,613 A 11/1999 Janusauskas
5,988,822 A 11/1999 Abe et al.
6,229,506 B1 * 5/2001 Dawson et al. ..... 345/82
6,613,455 B1 9/2003 Matsumoto et al.
6,621,212 B1 * 9/2003 Pennaz et al. ..... 313/506
6,656,608 B1 12/2003 Kita et al.
6,717,354 B1 4/2004 Kathirgamanathan
6,819,036 B2 * 11/2004 Cok ..... 313/318.01
6,833,669 B2 12/2004 George et al.
2003/0179167 A1 * 9/2003 Kolluri et al. ..... 345/85
2004/0027318 A1 * 2/2004 Kimura ..... 345/76
2004/0259454 A1 * 12/2004 Park et al. ..... 445/25
2005/0057154 A1 * 3/2005 Masumo ..... 313/506

OTHER PUBLICATIONS

Oxford English Dictionary, resealable.*
Oxford English Dictionary, seal.*
Oxford English Dictionary, sandwich.*

* cited by examiner

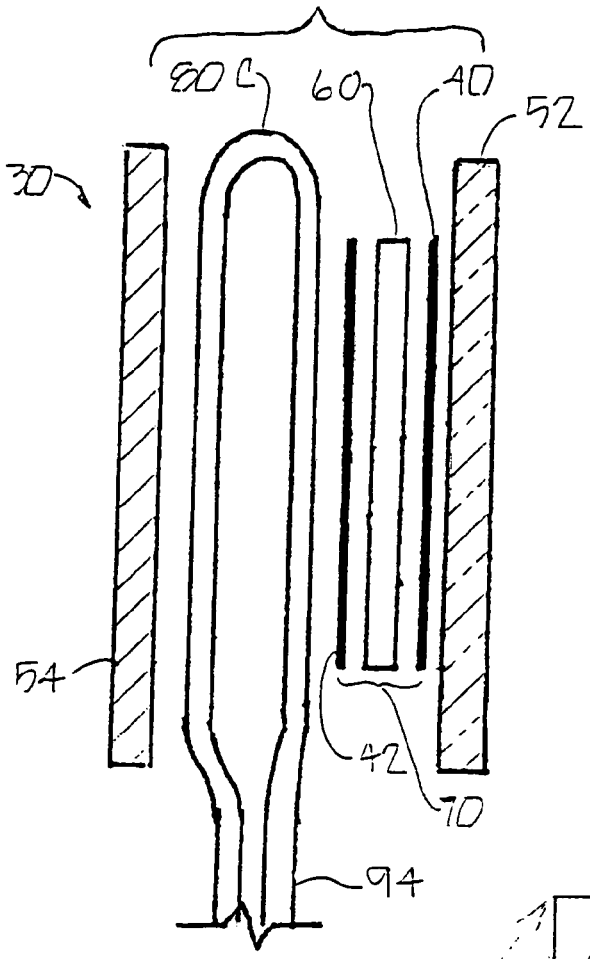
Fig. 3A
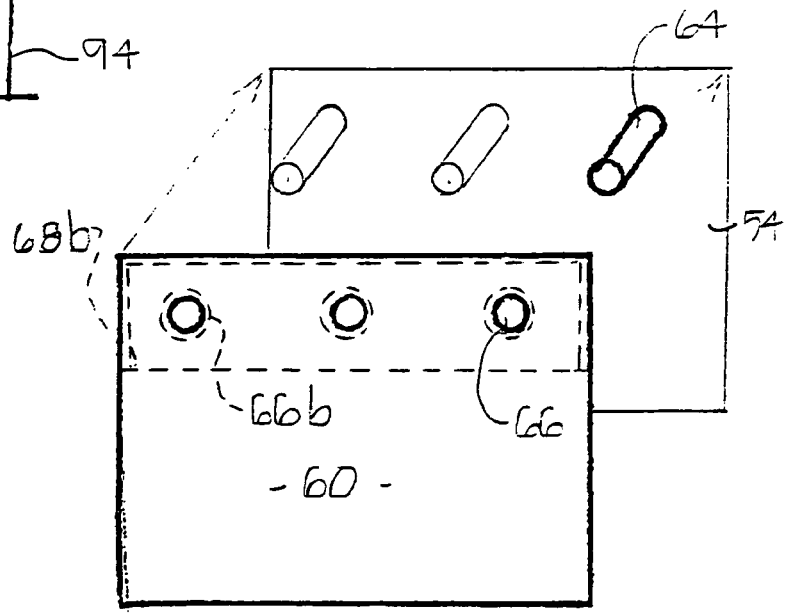
Fig. 6
Fig. 3
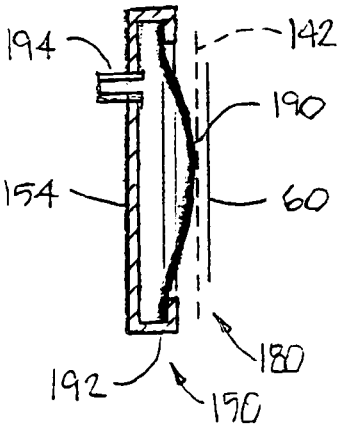

DISPLAY APPARATUS WITH REPLACEABLE ELECTROLUMINESCENT ELEMENT

CROSS REFERENCE TO RELATED APPLICATION

This application claims the benefit of the earlier filed provisional U.S. Patent Application Ser. No. 60/697,297 filed Jul. 8, 2005.

FIELD OF THE INVENTION

The present invention relates generally to electroluminescent devices and more particularly to an electroluminescent housing with a replaceable electroluminescent sheet adapted for luminescent displays.

BACKGROUND OF THE INVENTION

Prior art electroluminescent apparatus such as signs, segmented displays, dot-matrix displays, moving messages, computer and TV monitors may be comprised of an electroluminescent (EL) device which includes two electrodes and an electroluminescent material or phosphor layer sandwiched between. Typically, the electrodes are permanently attached to the phosphor layer. Over time, the phosphor loses brightness due to aging; however, the electrodes are still functional. It would therefore be beneficial to provide an electroluminescent apparatus which extends the useful life of an electroluminescent device by allowing for replacement of the electroluminescent phosphor layer.

Typical electroluminescent devices also consist of a single disposable unit, which may require that device be discarded once the phosphors have lost some of their brightness. Although the phosphor layer may be one of the least expensive components of the apparatus, the entire device is discarded. It would therefore be beneficial to provide a housing which allows for replacement of the phosphor layer, while allowing the remaining components to be reused.

Electroluminescent phosphor brightness decays based upon the applied voltage, frequency and waveform provided by the electronic circuitry. At a constant initial voltage and frequency, brightness will exponentially decrease with time of operation. Typically, the electroluminescent phosphor is preliminarily aged using a technique referred to as "rapid aging" by aging the devices after fabrication. However, this rapid aging leads to a reduction in brightness and useful lifetime. It would therefore be beneficial to provide a control circuitry which automatically controls the brightness.

It would also be beneficial to have an electroluminescent apparatus which provides an increase in brightness of the electroluminescent sheets and which is reusable, and allows the replacement of the electroluminescent sheet without the necessity to discard the entire device at the end of its useful lifetime.

SUMMARY OF THE INVENTION

In the embodiments of the present invention the aforementioned problems are addressed by providing an electroluminescent apparatus that utilizes a replaceable electroluminescent sheet which, in operation of the apparatus, is held between two electrodes that are within a resealable housing which may be opened and closed so that a used electroluminescent sheet may be removed from between the electrodes and replaced at the end of its usable lifetime. The housing has front and rear panels associated with the respective electrodes, at least one of the panels being transparent. The electroluminescent sheet is held between the electrodes when the housing is closed and may be removed from between the electrodes and replaced when the housing is opened. A compression structure is provided in the housing to assure close physical contact between the electrodes and the electroluminescent sheet when the apparatus is in operation. Other aspects of the invention include an inflatable compressing structure, an alignment structure within the housing for alignment of the electroluminescent sheet, transparent electrodes and various drivers that may be used allowing for monochrome or color displays. A housing having an envelope configuration, a roll of electroluminescent sheets or a tiled structure allowing for larger electroluminescent displays is also within the scope of the present invention. A method of replacing an electroluminescent device, which is part of the present invention, includes providing a resealable housing with first and second panels, positioning a sheet between the panels, operably sandwiching the sheet between a first and second electrode associated with respective panels and resealably securing the housing with the sheet positioned therein.

BRIEF DESCRIPTION OF THE DRAWINGS

FIG. 3 is a cross-sectional view of alternative aspect of the electroluminescent system having an inflatable membrane in accordance with to the present invention.

FIG. 3*a* is a cross-sectional, diagrammatic view of a second alternative aspect of the electroluminescent system having an inflatable compression structure in accordance with the present invention.

FIG. 6 is a perspective view of an aligning structure in accordance with the present invention.

DETAILED DESCRIPTION

I. Introduction.

As required, embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but as a basis for the claims and as a representative basis for teaching one skilled in the art to variously employ the present invention as desired.

II. Electroluminescent Apparatus.

Housing

Figure 1:
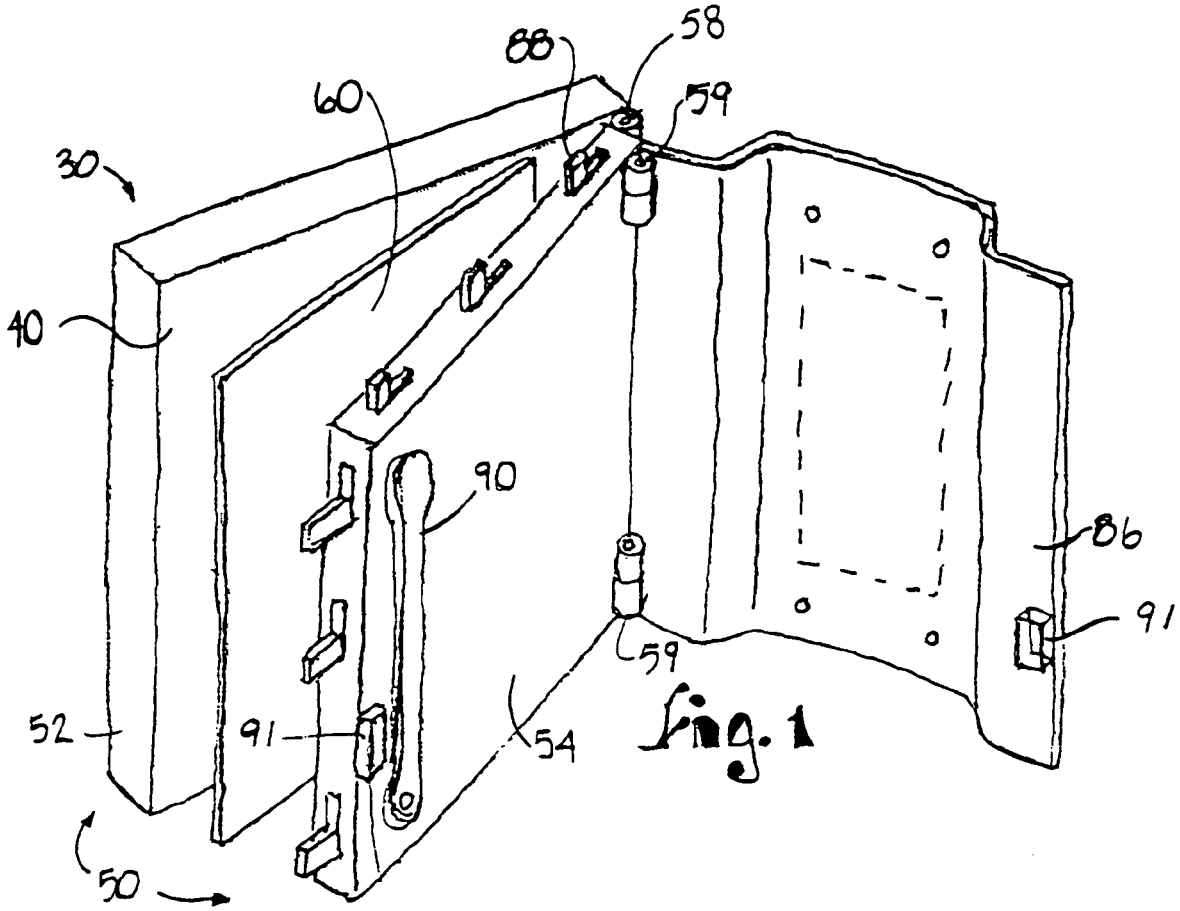
FIG. 1 is a perspective view of an embodiment of an electroluminescent system in accordance with the present invention, shown in an open condition.
Figure 2:
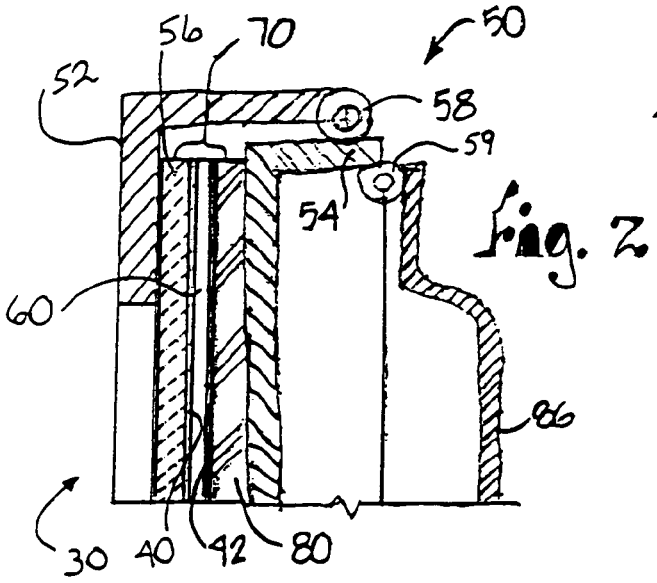
FIG. 2 is a cross-sectional view of the system according to the present invention, shown in an operative condition.

Referring to FIGS. 1-2, in an embodiment of the present invention an electroluminescent (EL) apparatus generally indicated by reference numeral 30 includes first and second spaced electrodes 40, 42, and a housing 50 adapted to receive a replaceable electroluminescent sheet 60 sandwiched between first and second electrodes 40, 42 to present an electroluminescent device 70. The housing 50 generally includes front and rear panels 52, 54 spaced from each other, the front panel 52 being associated with the first transparent electrode 40 and the rear panel 54 being associated with the second electrode 42. In operation, the housing 50 may be opened and closed. When closed, the front and rear panels 52, 54 in association with first and second electrodes 40, 42 receive the electroluminescent sheet 60 therebetween. When the housing 50 is open, the electroluminescent sheet 60 may be removed and replaced with another electroluminescent sheet.

The housing 50 is illustrated in the open position in FIG. 1 with the front panel 52 mechanically secured to the rear panel 54 with, for example but not as a limitation, a hinge 58 or other mechanical structure operably connected between the panels 52, 54 for replacement of the electroluminescent sheet 60. As shown, a complementary pair of hinges 59 connects the panels 52, 54 and the housing 50 along with an optional mounting bracket 86 for mounting the apparatus 30. In addition, the housing 50 may include an optional locking mechanism 88 with a release handle 90 for securing the housing 50 in a closed condition. Housing 50 may include an optional locking mechanism 91 for securing the housing 50 to the bracket 86 after replacement of the EL sheet 60.

Opening the housing 50 using the hinges 58, the electroluminescent sheet 60 can be readily replaced. After closing the hinged rear panel or back door 54, the electroluminescent sheet 60 may be pressed against the first electrode 40 (which should be transparent) by a compressing structure 80 discussed hereinbelow. Housing 50 may contain an overlay (not shown) between front panel 52 and front electrode 40. The overlay may present visual indicia or be any semi or partially transparent material, optionally presenting an image.

FIG. 2 illustrates the housing 50 in a closed position with the front and rear panels 52, 54 in association with first and second electrodes 40, 42 sandwiching the electroluminescent sheet 60. The compressing structure 80 is illustrated in FIG. 2 configured to compress the first electrode 40 in relation to the second electrode 42. In FIG. 2, any gap between the electrodes 40, 42 and the electroluminescent sheet 60 are for illustrative purposes only. While the housing 50 is in the closed position, there will be no noticeable gap between the electrodes 40, 42 and the electroluminescent sheet 60. The housing 50 is optionally illustrated with the front panel 52 being at least partially transparent, or having an opening associated with a transparent material (for example, a glass panel 56) positioned behind the front panel 52. The compressing structure 80 is generally fabricated from flexible, compressible material such as, but not limited to, rubber or sponge or some other resilient material. Generally, the compressing structure 80 is positioned between the second electrode 42 and the rear panel 54.

Figure 5:
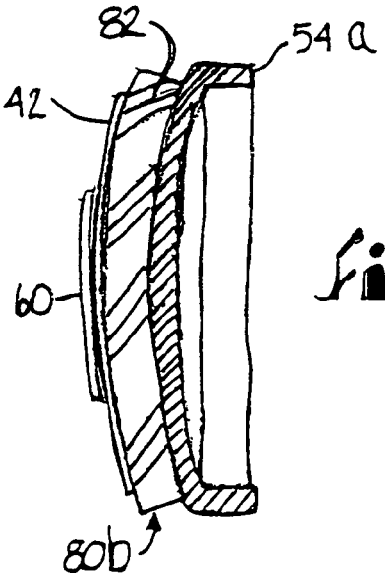
FIG. 5 is a cross-sectional view of an alternative aspect of a compression structure in accordance with the present invention.

FIG. 5 illustrates an alternative rear panel 54*a* having a convex surface and a compressing structure 80*b* constructed of a flexible, compressible material 82 having a convex surface and adapted to provide uniform pressure against the second electrode 42. In this way the electrodes 40, 42 may be optimally compressed to the electroluminescent sheet 60.

Inflatable Compressing Structure

FIG. 3*a* illustrates an alternative configuration of the apparatus 30 having an inflatable compressing structure, also referred to herein as an inflatable structure 80*c*, positioned between the rear panel 54 and the EL device 70 which includes the sheet 60 sandwiched between the first and second electrodes 40, 42. In this configuration the inflatable structure 80*c* has an intake 94 in fluid communication with a source of pressure, for example, an air or hydraulic pump (not shown) for inflating the structure 80*c*. As the structure 80*c* inflates, the EL device 70 is pressed together. An air gap in the EL device 70 may be reduced by using at least two flexible components in the EL device 70 (such as the electroluminescent sheet 60 or the first or second electrode 40, 42). As structure 80*c* inflates the flexible components press against each other and the front panel 52, thereby providing a closer physical connection in the EL device 70.

FIG. 3 illustrates a second alternative inflatable compressing structure 180 including a flexible membrane 190 incorporated within a rear panel 154 to define a chamber 192 therebetween. The rear panel 154 also has an intake 194 that is in communication with the pressure source (not shown) for inflating the membrane 190 and assuring a closer physical connection between the electroluminescent sheet 60 and the corresponding electrode 142.

Electroluminescent Sheet

Figure 4A:
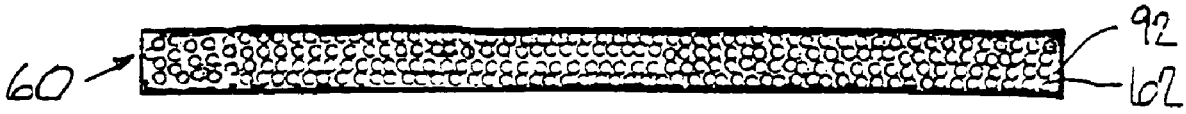
FIG. 4*a* is a cross-sectional, diagrammatic view of an aspect of an electroluminescent device associated with a front panel in accordance with the present invention.

The electroluminescent sheet or element 60 illustrated in FIG. 4*a* is shown between the first and second electrodes 40, 42, overlying the front panel 52. The thickness of the sheet 60 may vary depending on the sheet's physical dimensions. Up to approximately 8.5×11 inches in size, the electroluminescent sheet 60 can be in the range of 25-50 microns thick. For larger sizes, handling of the electroluminescent sheet 60 may become more difficult, and the thickness may need to be increased. In addition, a proportional increase of the voltage between the electrodes 40, 42 may be required to maintain the same brightness of the electroluminescent sheet 60.

In general, the electroluminescent sheet 60 is a flexible film in the range of 25-100 microns thick and can be fabricated in sheets or rolls. A sheet of plastic or organic resin film 92 can be used with impregnated EL phosphorous powder 62 as illustrated in FIG. 4*a*. The sheet 60 can also include areas of different colors, areas without phosphors 62 or areas selectively coated with another material such as, but not limited to, conventional ink. Selectively coating the sheet may provide a visual illustration or indicia. In addition, reducing the amount of phosphorous powder 62 associated with the electroluminescent sheet 60 may provide an economic benefit.

Figure 4B:
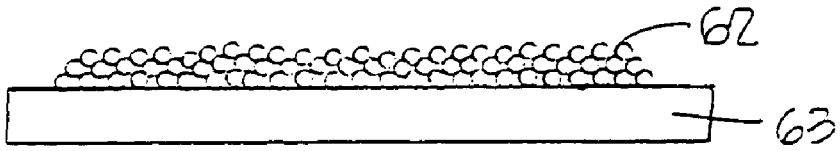
FIG. 4*b* is a cross-sectional view of an alternative aspect of an electroluminescent sheet in accordance with the present invention.
Figure 4C:
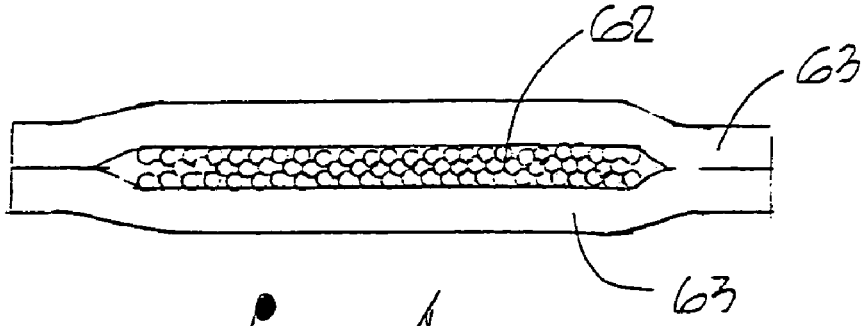
FIG. 4*c* is a cross-sectional view of an alternative aspect of the electroluminescent sheet in accordance with the present invention.

The replaceable electroluminescent sheet 60 is illustrated in FIG. 4*a* having impregnated electroluminescent phosphor 62. Alternatively, the electroluminescent phosphor 62 may be deposited on one side of an insulative film 63 as shown in FIG. 4*b* or plural insulative films 63 may be provided as shown in FIG. 4*c*, sandwiching the electroluminescent phosphor 62 therebetween.

Operation

In operation the present invention may be practiced by providing the housing 50 having front and rear panels 52, 54, associating first and second electrodes 40, 42 respectively with the panels 52, 54, positioning the replaceable electroluminescent sheet 60 within the housing 50 between the panels 52, 54 and operably sandwiching the sheet 60 between the electrodes 40, 42, and then releasably securing the housing 50 with the sheet 60 positioned therebetween.

Alignment Structure

Electroluminescent sheets 60 may be adapted for color display through the use of tricolor phosphors which may require precise positioning of the electroluminescent sheet 60. Tolerance may be limited based on the configuration of the electrodes 40, 42. Therefore, the positioning of the electroluminescent sheet 60 should be generally fixed before closing the housing 50.

Fixing the position of the electroluminescent sheet 60 may be accomplished using a variety of techniques including adhesives or mounting structure like pegs and peg receivers. FIG. 6 illustrates the use of the electroluminescent sheet 60 having two or more alignment receivers or peg holes 66 with matching alignment pegs 64 operably positioned within the housing 50 (not shown). Although FIG. 6 illustrates the receivers 66 as being round for receiving the round pegs 64, the receivers 66 can have varying shapes and sizes such as but not limited to round, square or of any other shape that fixes the position of the sheet 60. Pegs 64 can also have varying, complementary, shapes and sizes and may be arranged in a horizontal-mounting arrangement within the housing 50, or they may be mounted at an upward angle, or with upwardly extending hooks.

Figure 7:
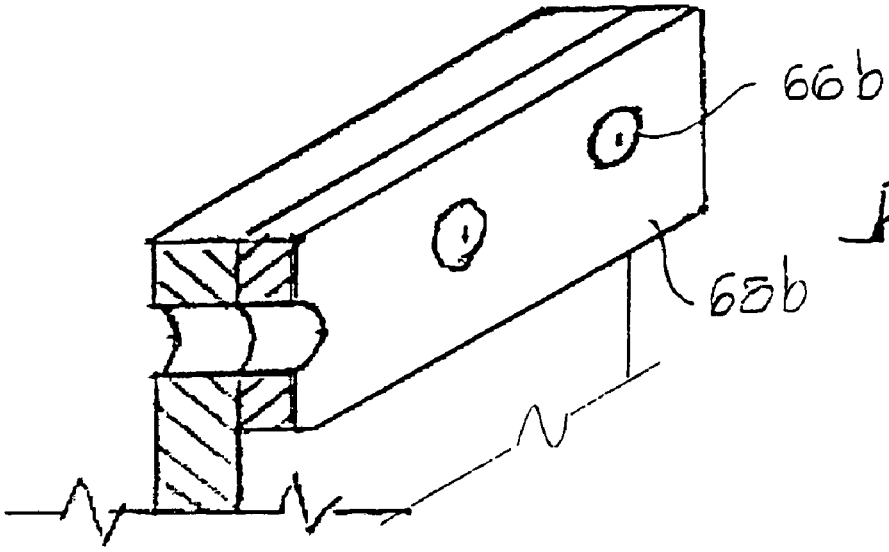
FIG. 7 is a side perspective view of an alignment reinforcing structure in accordance with the present invention.

In general, the alignment pegs 64 may be associated with either the front or rear panel 52, 54 of the housing 50 and the sheet 60 can have plural alignment receivers 66 placed thereon for receiving the pegs 64 and aligning the sheet 60 with first and second electrodes 40, 42 (not shown). Optionally, a reinforcement layer 68*b* having plural reinforcement receivers 66*b* may be associated with the sheet 60 and configured to receive the alignment pegs 64, reinforcing and at least partially overlying the alignment receivers 66, as shown in FIG. 7.

Envelope Housing

Figure 8:
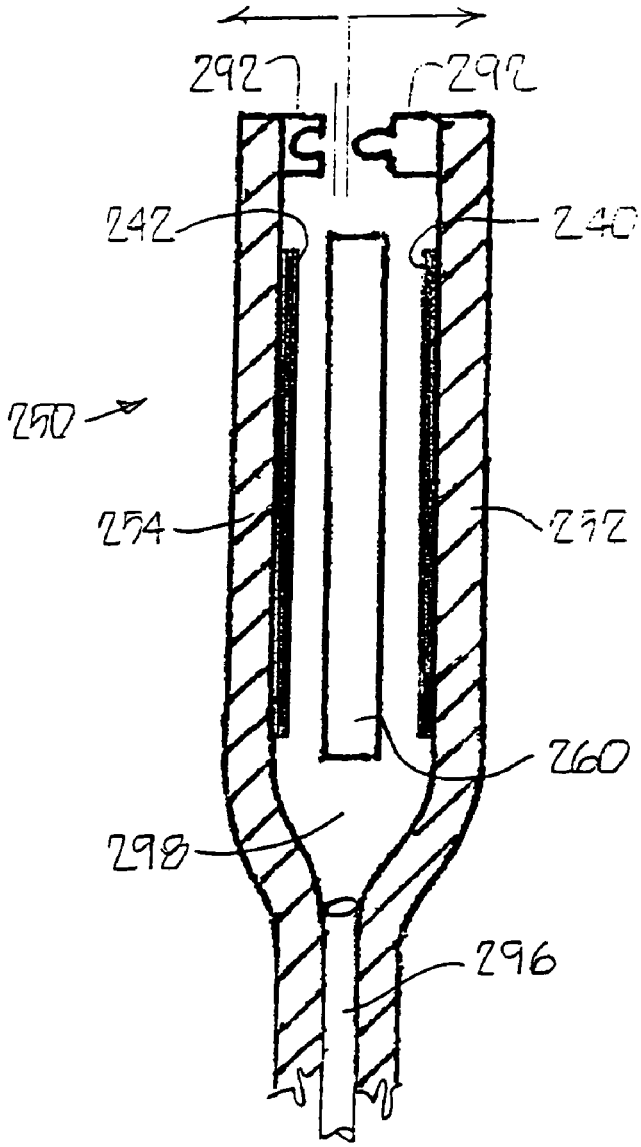
FIG. 8 is a cross-sectional view of an alternative housing in accordance with the present invention.

An alternative configuration of a housing 250 in an open condition is illustrated in FIG. 8 having a front panel 252, a rear panel 254 and a resealable gasket 292 located between them having complementary sealing structure for releasably sealing the housing 250. The front and rear panels 252, 254 are associated with a first and second electrodes 240, 242 respectively. In this configuration, the housing 250 encases the electroluminescent sheet 260. The front and rear panels 252, 254 sealed by the gasket 292 define a chamber 298. The housing 250 may also include a structure 296 in fluid communication with the housing 250 for depressurizing the housing 250. As the housing is depressurized, the sheet 260 and electrodes 252, 254 shift, promoting closer physical contact therebetween. For example, a vacuum pump (not shown) may be used to depressurize the housing 250 with one of the panels 252, 254 being flexible.

After the housing 250 is closed and the gasket 292 is sealed, the air from the housing 250 may be evacuated, pressing electrodes 240, 242 towards the sheet 260. Air may be evacuated with a vacuum pump or with another type of device with or without a vacuum tank.

The configuration of the housing 250 may be described as a sealed envelope, optionally having at least one transparent panel and at least one flexible panel. After the electroluminescent sheet 260 is installed, the envelope 250 may be sealed by a releasable complementary seal, zipper, mechanical clip or closure which provides a hermetic seal.

Figure 8A:
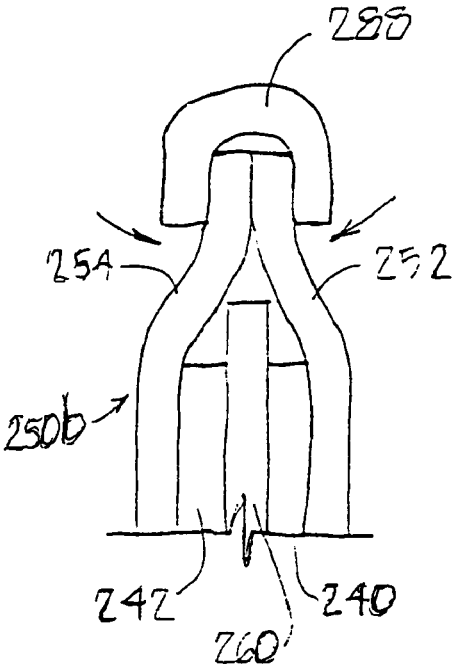
FIG. 8*a* is a cross-sectional view of an alternative aspect of the housing of FIG. 8 in accordance with the present invention.
Figure 8B:
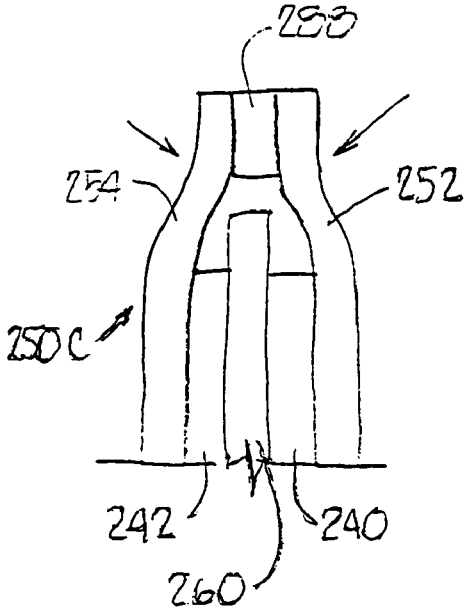
FIG. 8*b* is a cross-sectional view of another alternative aspect of the housing of FIG. 8 in accordance with the present invention.

Alternatively, as illustrated in FIGS. 8*a* and 8*b*, the housing 250*b*, 250*c* may include an adhesive tape joint 288 replacing the gasket 292, sealing the front and rear panels 252, 254 of the alternative housing 250*b*, 250*c*, around first and second electrodes 240, 242 with electroluminescent sheet 260 sandwiched therebetween.

Rolled Electroluminescent Sheet

Figure 9:
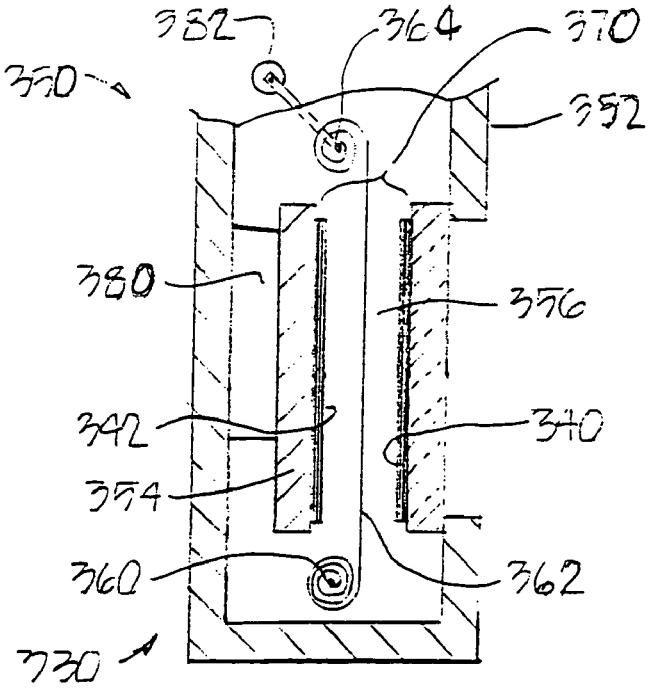
FIG. 9 is a partial cross-sectional view of a second alternative housing in accordance with the present invention.

For an electroluminescent phosphor, its lifetime is inversely proportional to its brightness. When high brightness is required and frequent replacement of electroluminescent sheets may be desired, an alternative embodiment of the electroluminescent housing 350, illustrated in FIG. 9, may be used. A supply or roll 360 of sequential electroluminescent sheets 362 is received within the housing 350. The roll 360 may be fabricated using flexible materials including, but not limited to, plastic or organic resin film, providing flexible electroluminescent sheets 362 having a small bend radius. The sheets 362 may be layered to sandwich the electroluminescent phosphor particles of sequential sheets 362. The supply 360 may be fabricated from individual sheets 362 sequentially attached together or the supply 360 may be fabricated as one long sheet with individual sequential sheets or areas 362 located therein. The housing 350 receives the supply 360 of flexible material which presents plural spaced apart sequential electroluminescent sheets 362 positioned within the housing 350.

The housing 350 is illustrated in the open position having front and rear panels 352, 354 defining a display area 356. The display area 356 includes a first and second electrode 340, 342 contained within the housing 350 and associated with the front and rear panels 352, 354 respectively. The housing 350 also contains a take-up structure 364 which receives the sequential electroluminescent sheets 362. As the sheet 362 is spent or depleted of its luminescent properties, the spent electroluminescent sheet 362 is sequentially moved from the supply 360 through the display area 356 between the first and second electrodes 340, 342 to the take-up structure 364 positioning the next sequential sheet 362 within the display area 356. After each sequential electroluminescent sheet 362 traverses the display area 356 a compression mechanism 380 moves the rear panel 354 forward and compresses the EL device 370, thereby promoting closer physical contact between the sheet 362 and the electrodes 340, 342.

The configuration of the supply of sequential sheets 360 within the housing 350 is similar to film cameras or projectors. The electrodes 340, 342 may optionally be frictionally pressed against the sequential sheet 362 by mechanical means, compressed air, vacuum, or any other known method. When the brightness of the portion of the electroluminescent sheet 360 positioned within the display area 356 falls below a desired level, the next sequential sheet 362 within the electroluminescent roll 360 is positioned within display area 356. This can be configured in either a vertical or horizontal orientation. Sequential movement of the sheets 362 may be similar to advancing a roll of film in a camera. All operations can be done manually or automatically with a drive mechanism 382 or a release structure.

For example, a compression mechanism 380 may be synchronized with the drive mechanism 382 such that the compression mechanism 380 is uncompressed when the drive mechanism 382 operates. After the drive mechanism 382 positions the next sequential electroluminescent sheet 362 in the display area 356, the compression mechanism 380 promotes closer physical contact between the electrodes 340, 342 and the sheet 362.

Transparent Electrodes

Figure 10:
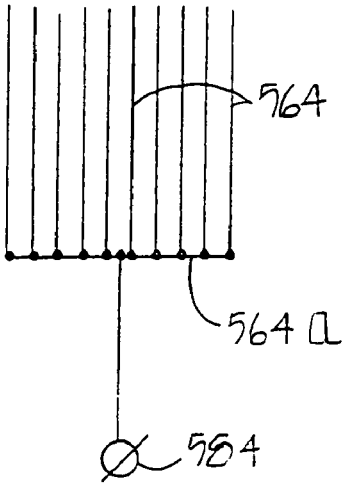
FIG. 10 is a plan view of an alternative aspect of an electrode in accordance with the present invention.
Figure 11:
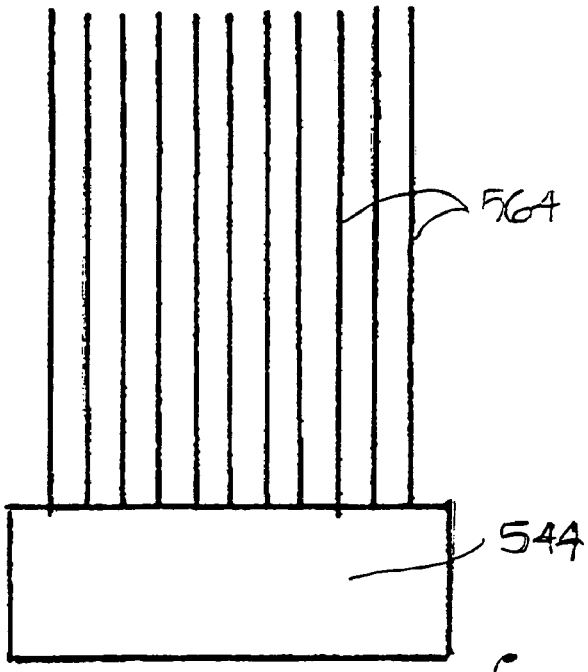
FIG. 11 is a plan view of a second alternative aspect of an electrode in accordance with the present invention.
Figure 12:
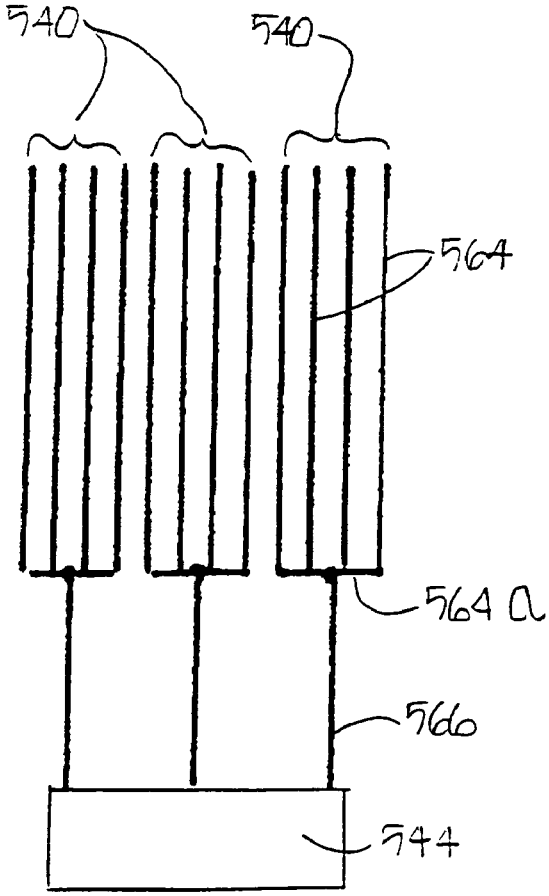
FIG. 12 is a plan view of a third alternative aspect of an electrode in accordance with the present invention.
Figure 13:
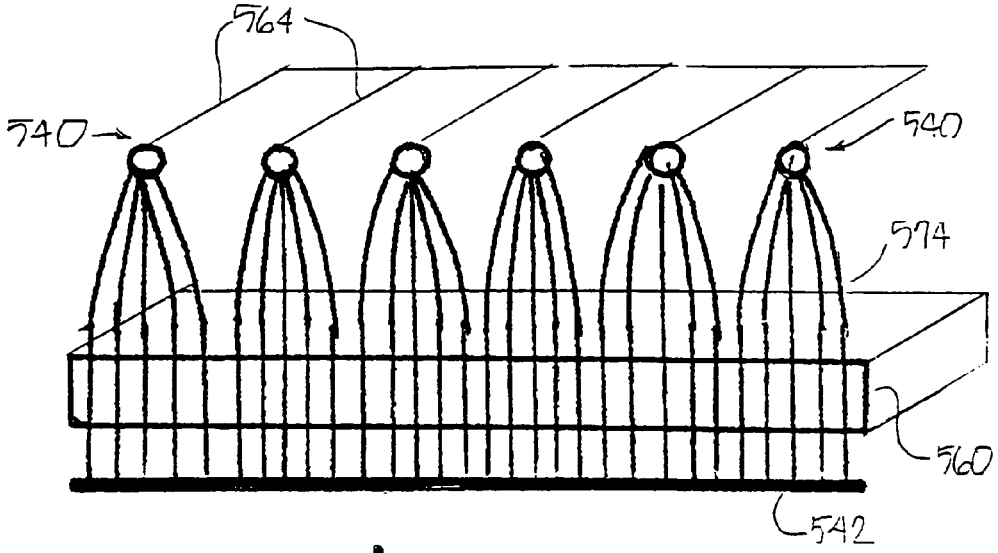
FIG. 13 is a diagrammatic illustration of the electrical field between the electrodes.

Instead of indium tin oxide (ITO) films, plural thin parallel electrical contacts or wires 564 may be used as transparent electrodes as shown in FIGS. 10-13. The wires 564 can be connected together forming a single integrated and larger transparent electrode, as shown in FIG. 10 or used separately (FIG. 11) as pixel electrodes for displays and controlled by a display driver 544. For larger displays, wires 564 can be connected together in parallel at 564*a* to form individual electrodes 540 as illustrated in FIG. 12. The gap between first and second electrodes 540, 542 can be relatively small allowing a strong electrical field in the electroluminescent sheet 560 as illustrated in FIG. 13. Large gaps are not desirable because as distance between the electrodes 540, 542 increases, the required voltage must also increase to provide the same electrical field and same brightness of the electroluminescent sheet 60.

Figures 14, 15, 16:
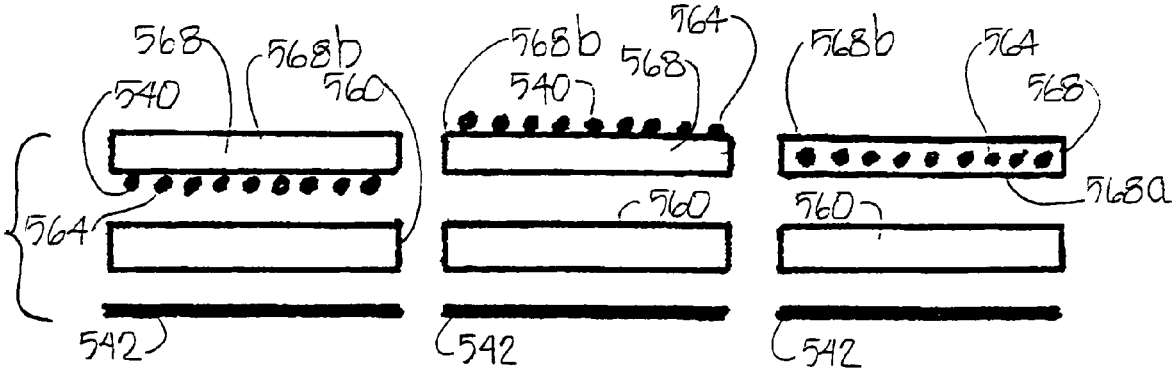
FIG. 14 is a cross-sectional view of an alternative aspect of a transparent electrode in accordance with the present invention.
FIG. 15 is a cross-sectional view of another alternative aspect of the transparent electrode in accordance with the present invention.
FIG. 16 is a cross-sectional view of a third alternative aspect of the transparent electrode in accordance with the present invention.

FIGS. 14-16 illustrate an alternative embodiment with a transparent electrode 540 consisting of parallel electrical contacts 564 generally fabricated from a metal. Electrical contacts 564 may be incorporated within a transparent material 568 as illustrated in FIG. 14. Alternatively, parallel wires 564 may be associated with a proximal or distal side 568*a*, 568*b* of the transparent material 568 (FIG. 15-16), or sandwiched between two transparent materials such as, but not limited to, glass or plastic. Optionally, a coating may be applied to the electrical contacts 564, presenting a smooth electrode surface.

An increase of the distance between the wires 564 and the second electrode 542 provides a wider and more uniform luminescence of the electroluminescent sheet 560, but this configuration also requires the voltage to be increased to maintain the same sheet brightness. This is illustrated in FIG. 13, with a plurality of lines of electrical force 574 extending between the first electrode 540 to the second electrode 542 through the sheet 560. As the electrodes are separated from each other, these lines of electrical force 574 become more uniform within the sheet 560.

Figure 17:
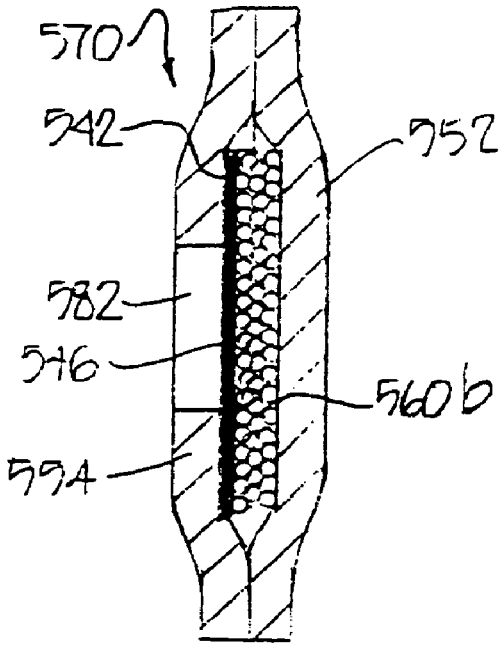
FIG. 17 is a cross-sectional view of an alternative aspect of an electroluminescent sheet in accordance with the present invention.

Another embodiment of the invention is illustrated in FIG. 17 with a phosphor layer 560*b* being associated with the optionally transparent second electrode 542, in an alternative embodiment of an electroluminescent sheet 570 received within a housing such as shown at 50 in FIG. 2. As previously set forth, the alternative housing (not shown) has a front and rear panel 52, 54 and first electrode 40 associated with one of said panels. The second electrode 542 has a continuous surface as shown in FIG. 17 and is combined with the electroluminescent sheet 570. The second electrode 542 may be fabricated from an inexpensive material such as aluminum foil. Films 552 and 554 are located on opposite sides of the combination of the phosphor layer 560*b* and second electrode 542. The second electrode 542 is also shown with an exposed surface 546, accessible through an access opening 582 in film 554 for connection to a power source or driver (not shown). Alternatively, the second electrode may be segmented to light up different parts of the device or display independently, in which case, each segment of the second electrode should be electrically connected to the driver.

Segmented Display

Figure 18:
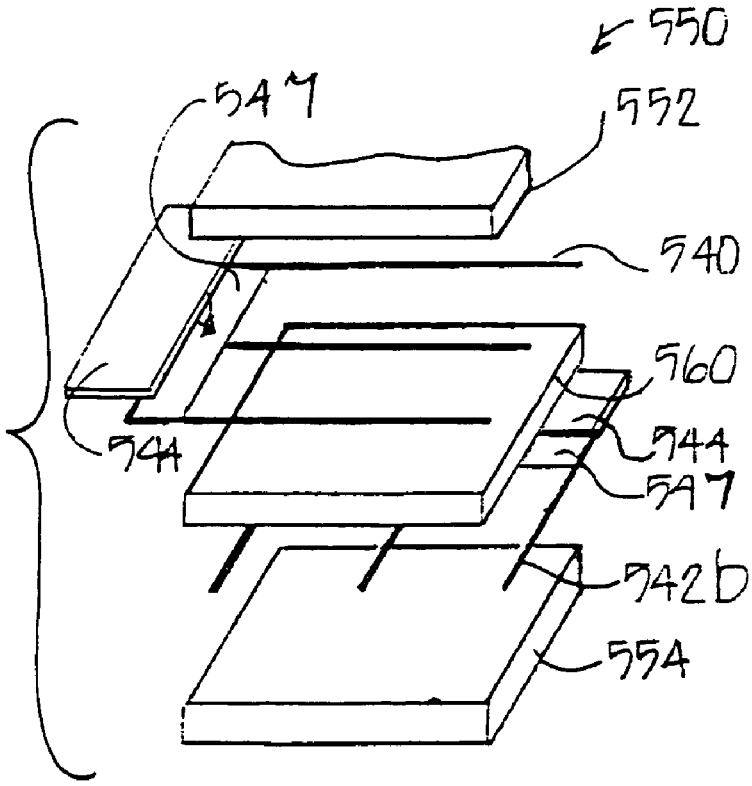
FIG. 18 is an exploded perspective view of a dot matrix configuration in accordance with the present invention.

First or second electrode 540, 542*b* enclosed in the housing 550 can be adapted for a segmented or dot-matrix display. A segmented display may be provided where the electrode is segmented into squares, disks, triangles or other shapes. As shown in FIG. 18, a dot matrix display may be provided by segmenting the electrodes 540, 542*b* into transverse, or as shown here, perpendicular rows and columns. In this arrangement, each segment of the electrodes 540, 542*b* should have an electrical contact within connector 547 for connection to a driver 544. In a monochrome dot matrix display, the number of horizontal electrodes 540 is equal to the number of rows of pixels and the number of vertical electrodes 542*b* is equal to the number of columns of pixels.

Color Dot Matrix

Figure 19:
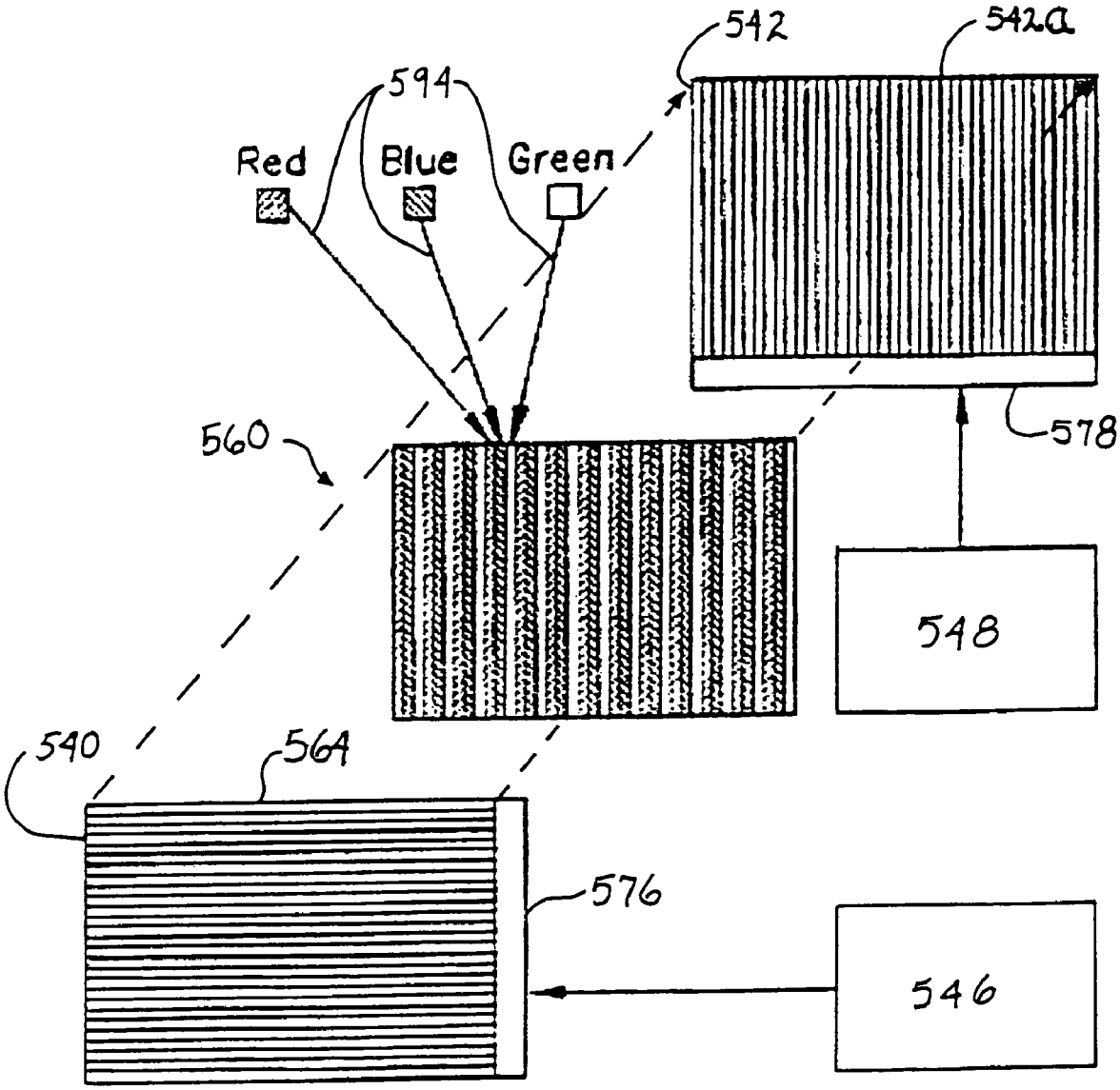
FIG. 19 is a diagrammatic exploded view of a color dot matrix configuration in accordance with the present invention.

For color dot-matrix displays, alternating strips or dots of colored phosphor 594 such as red, green, and blue might be applied to the electroluminescent sheet, as shown on FIG. 19. Red, green and blue colored phosphors might be applied, in any order to each pixel. In addition, the first electrode 540 which is optionally transparent has plural rows of parallel, horizontal electrode strips 564 connected by a first connector 576 which may be connected to a first, horizontal controller 546. The second, optionally transparent, electrode 542 has plural columns of parallel, vertical strips 542*a* connected by a second connector 578 to a second, vertical controller 548 and are transverse or here perpendicular to the rows of electrode 540. The numbers of horizontal electrodes 540 is equal to the number of rows of pixels and the number of vertical electrodes 542*a* is three times greater than the number of columns of pixels.

Figure 20:
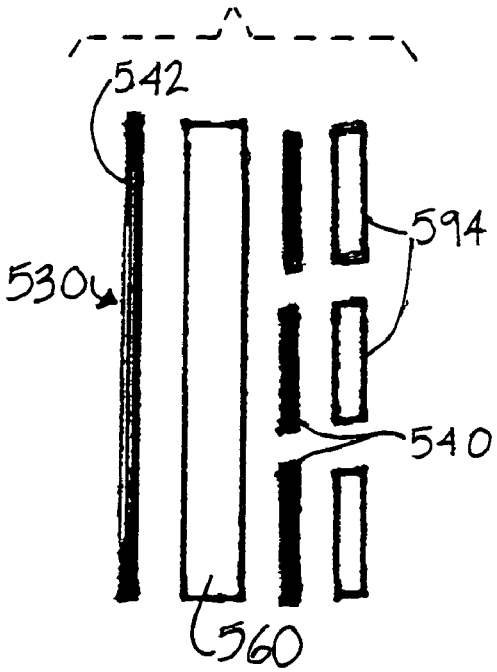
FIG. 20 is a diagrammatic, exploded view of an alternative electroluminescent device according to the present invention, including color filters.

The electroluminescent sheet 560 with monochrome electroluminescent phosphors might also be used in combination with a non-conductive layer of colored filters 594 placed outside of and overlying the first electrode 540 as shown on FIG. 20 (one color pixel is shown). In this arrangement each of the multi-colored fillers 594 is associated with a respective first electrode 540 to provide a color display. Monochrome EL phosphors can be white or of any other color that works efficiently with red, green and blue filters. Unfortunately, some filters can reduce the brightness of an EL device. However, utilization of fluorescent materials or laser dyes that transform light from the electroluminescent sheet 560 to multiple colors like red, green and blue may also be used to provide a color display, while for higher efficiency and less reduction in brightness. The fluorescent material or laser dyes may be placed outside of the first optionally transparent electrode 540 instead of using filters 594 as shown on FIG. 20.

While existing EL phosphors have comparably low brightness and lifetime, phosphors for fluorescent and gas discharge devices have high brightness and lifetime. For instance, phosphors for fluorescent devices have brightness characteristics over a thousand Ft-Lamberts and a lifetime of up to 100,000 hours without a change in color. They can be used with devices having suitable EL phosphors which emit light that efficiently activates the fluorescent phosphors. This can be accomplished by replacing the phosphor electroluminescent sheet 560 with an ultraviolet electroluminescent sheet and using multi-colored fluorescent phosphor (red, green and blue) instead of a colored filter. While fluorescent device phosphors were developed to be activated by ultraviolet light with a 254 nm wavelength peak, their utilization within electroluminescent devices can lead to usage of different wavelengths. The present invention may also be used with real color phosphors or other tri-color systems.

Drivers

Horizontal passive matrix drivers 546 which control horizontal electrodes, such as the longitudinal electrodes 564 shown in FIG. 19, can be based on shift registers, while vertical drivers 548 controlling vertical electrodes 542*a* may include sample and hold elements equal to the number of pixels in the horizontal row for monochrome displays and three times as much for color displays of the same resolution. In many aspects, these passive matrix drivers 546, 548 are similar to passive matrix LCD drivers, but have a controllable high-voltage output proportional to the brightness of each of the color sub pixels 594 which combine together as a pixel. As an option, the drivers 546, 548 may have a low-voltage control circuit with high-voltage output transistors or transistor arrays allowing voltages over a kilovolt to be achieved. The electroluminescent apparatus may also use custom designed drivers or existing drivers with some modifications.

CRT Driver

Figure 21:
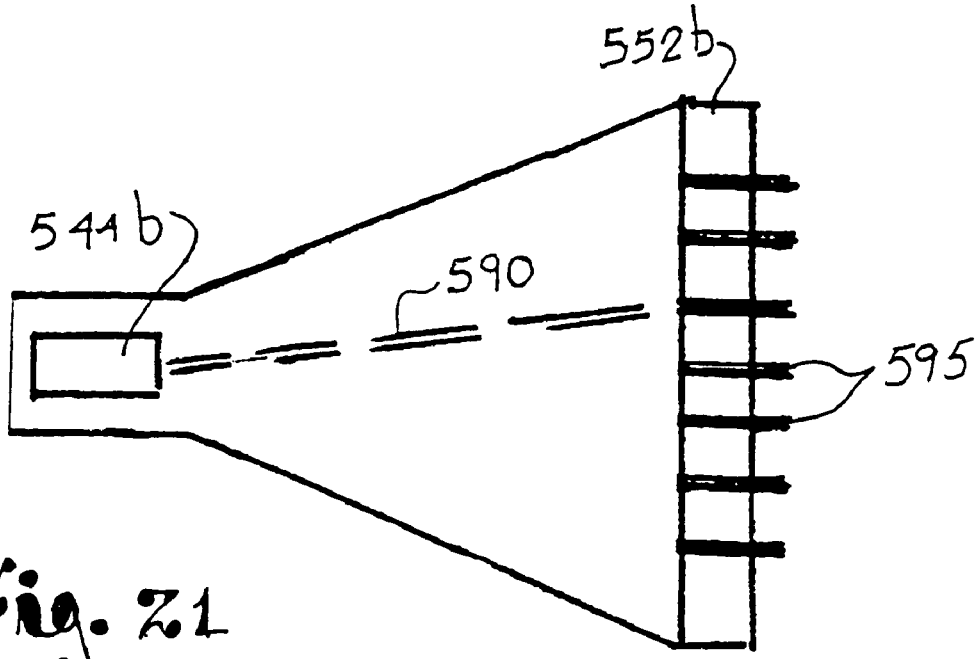
FIG. 21 is a diagrammatic view of a CRT driver in accordance with the present invention.

When very high voltages are required, a special cathode ray tube (CRT) driver with electron gun 544*b* can be used as shown in the alternative embodiment of FIG. 21. In this embodiment, the driver is a cathode ray tube with the electron gun 544*b*, a front panel 592 which is at least partially made of non-conductive material and a plurality of electrodes 595 which are impregnated within the front panel 592, and are connected to electrodes 540, or 542. As the electron beam 590 scans the electrodes 595, the corresponding pixels of the electroluminescent sheet 560 (not shown) are activated. The CRT tube driver can be of any conventional design except that wires are impregnated in the front panel 592 instead of phosphors covering the inside surface. In this configuration, voltages ranging from a few kilovolts to a few dozen kilovolts can be achieved to illuminate the electroluminescent sheet 560.

Tiled Electroluminescent Sheet

Figure 23:
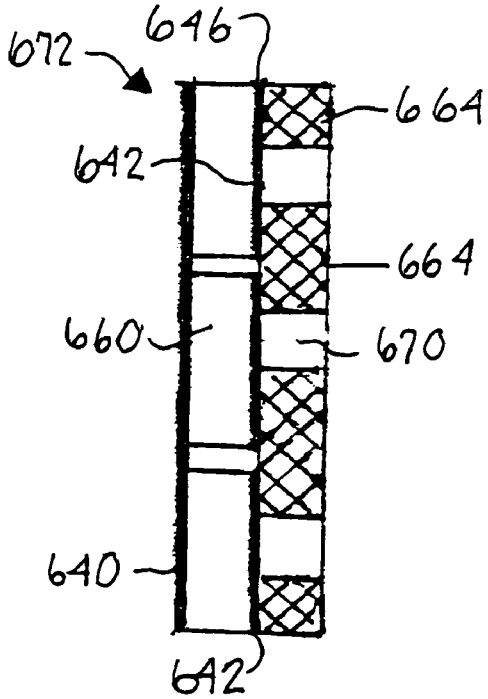
FIG. 23 is a cross-sectional view of the tiled electroluminescent sheet of FIG. 22.
Figure 22:
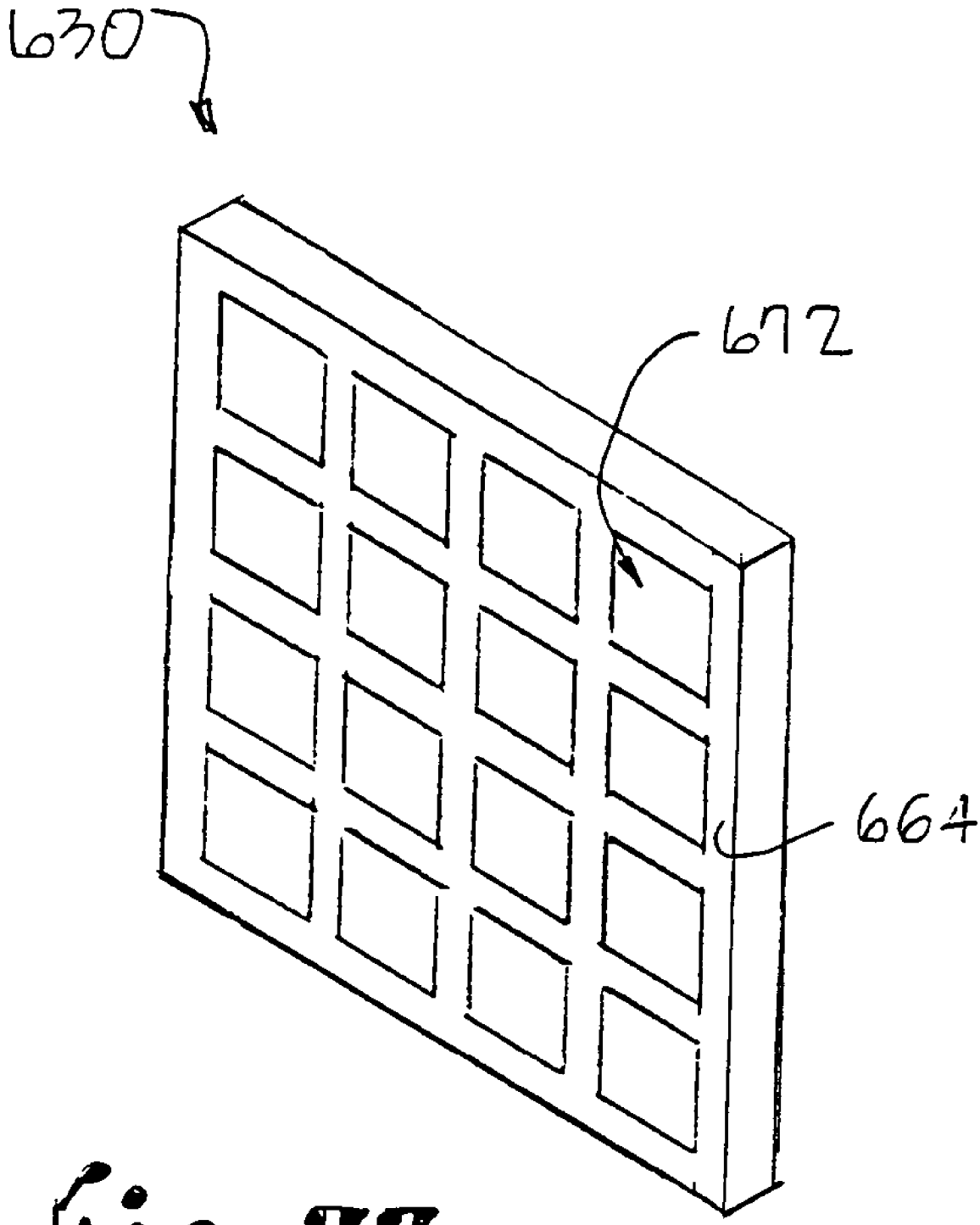
FIG. 22 is a perspective view of an alternative aspect of the electroluminescent sheet including a tiled surface.

An increase in the size of an EL sheet 630 can lead to difficulties and expenses associated with the increased size of the electroluminescent sheet 630. In some cases, thin-film phosphors may need to be grown as layered crystals on a second rigid surface, usually glass which may increase the cost of the apparatus. However, an array of comparatively small tiles 672 may be used for a larger apparatus as illustrated in FIG. 22. Each tile 672 illustrated in FIGS. 22, 23 has a conventional layer of thin-film EL material which is deposited on a rigid substrate such as glass, ceramic plate, plastic, or other insulating material associated with a sheet 664 of insulating material. Each rear electrode 642, for each segment, as shown in FIG. 23 is connected to corresponding electrical contact (not shown) via conducting component 670.

Figure 25:
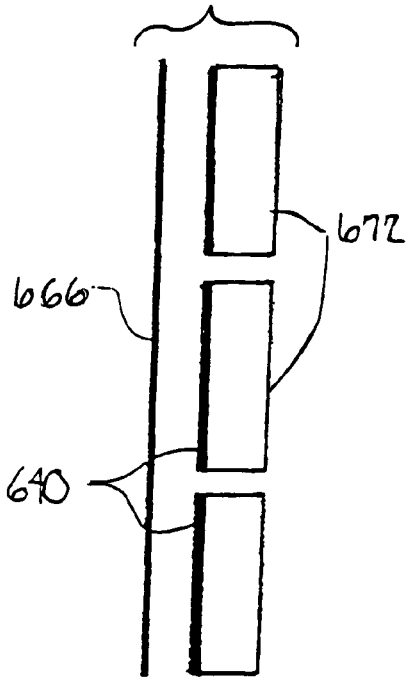
FIG. 25 is a cross-sectional diagrammatic view of a second alternative aspect of the tiled electroluminescent sheet.

An optionally transparent, first electrode 640 may be common to plural pixels on the tile 672. The EL phosphors for each sub pixel can have different colors or alternating color areas, such as red, green and blue. The first electrodes 640 of each tile 672 can be connected together by wires, conductive adhesives or any other means. The electrodes 640 may also be pressed against another common transparent electrode 666 as illustrated in FIG. 25. All tiles 672 assembled in one large electroluminescent sheet should be placed in a sealed enclosure to prevent them from damage.

The thin-film EL sheet described above and shown in FIGS. 22, 23 and 25 is an arrangement for an active matrix display. For the passive matrix activation of the individual pixels, the first electrodes of each tile and the first, common electrode for all tiles should be divided in vertical or horizontal strips of a width equal to the size of each individual sub pixel, providing a sufficient gap between each sub pixels and between each transparent electrode. The invention can also be used with interlaced scanning, dual scanning or other scanning methodologies.

Figure 24:
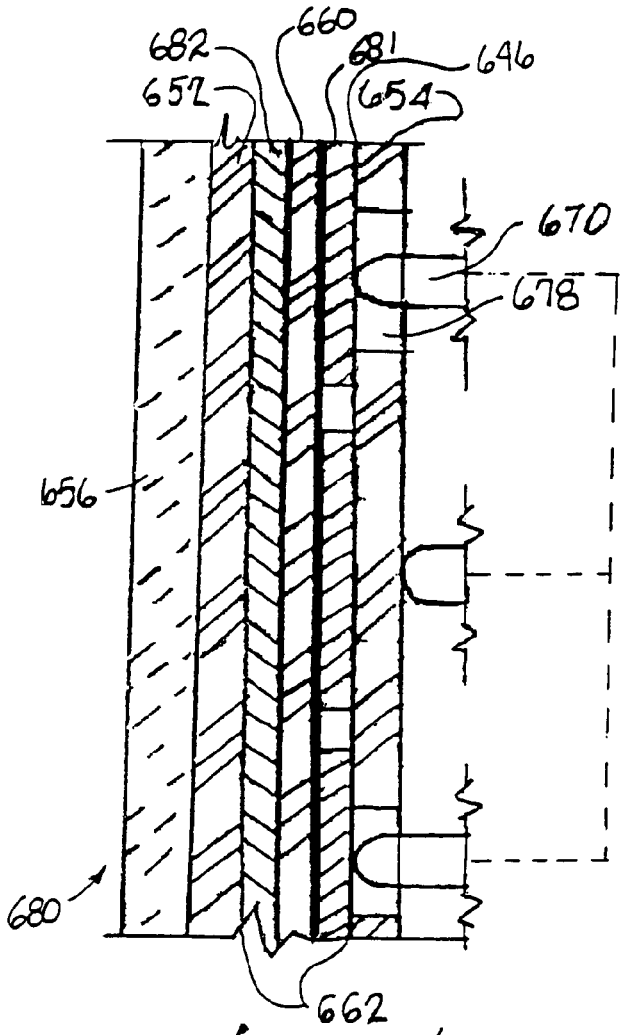
FIG. 24 is a cross-sectional view of an alternative aspect of the housing with pixeled rear electrode.

FIG. 24 illustrates another embodiment of the invention with pixelated second electrode 681. A resealable housing has front and rear panels 652, 654 receiving an electroluminescent device 662 which is presented by the first and second electrodes 682 and 681 and electroluminescent sheet 660. The electrodes sandwich electroluminescent sheet 660 therebetween. The first electrode 682 is illustrated with a continuous electrical contact while the second electrode 681 has a non-continuous or pixelated surface 646 which is accessible through the holes 678 in special non-conductive separating sheet 654. Optionally flexible electrode 681 may be fabricated from double-sized printed circuit board material. Each pixel of electrode 681 has corresponding contact members or contacts 670 which maybe connected to a controller or power supply. Contacts 670 can be electrically connected to pixeled surfaces 646 if a hole 678 exists in sheet 654 (FIG. 24). In case of electrical contact, corresponding surface 646 is connected to a power supply or controller, and this pixel is activated. Optionally, all contacts 670 can be connected together as shown in dashed lines in FIG. 24.

Automatic Brightness Control

Figure 26:
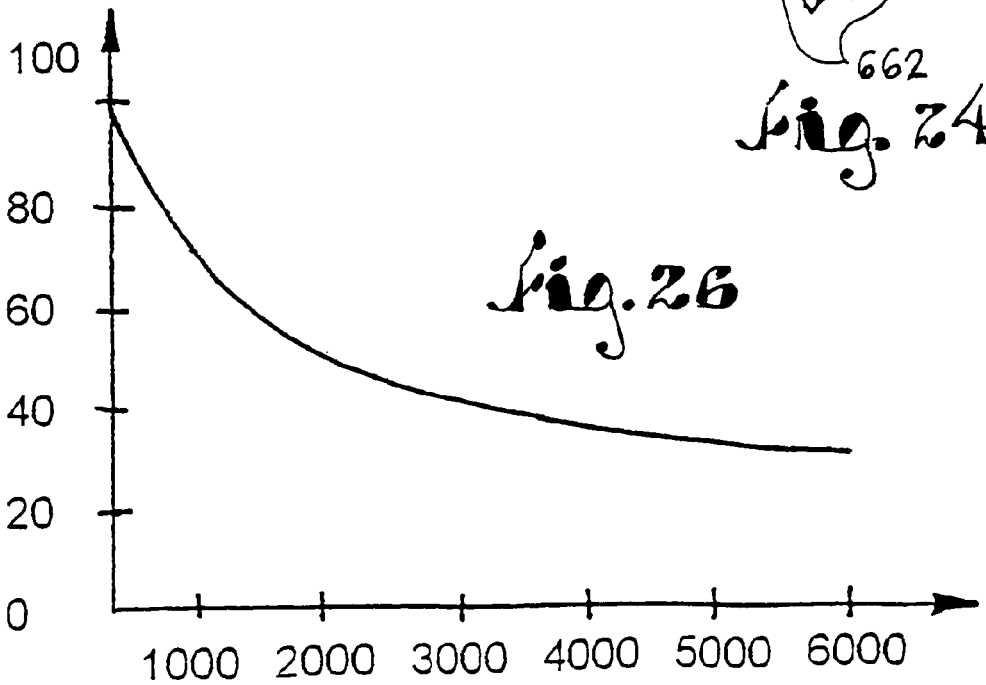
FIG. 26 is a graph of the brightness characteristic of the electroluminescent sheet.

As illustrated in the graph of FIG. 26, the brightness of electroluminescent phosphors is inversely proportional to its time in operation; the brightness may exponentially decline with time of operation at a constant initial voltage and frequency. However, a constant brightness can be obtained by initially maintaining the brightness of the phosphor at 50-75% of the maximum brightness using a minimum voltage and frequency. Reduction in brightness can be adjusted by increasing the voltage at a constant frequency. After the voltage is increased to its available maximum, frequency may be increased to a reasonable level. This technique requires a very simple circuit of about a dozen transistors with other necessary components that can be fabricated as a comparatively simple and inexpensive multi-channel integrated circuit.

A controller with brightness adjustment electronic circuitry may be coupled to the electroluminescent apparatus such as the one depicted in FIG. 19, or any other type mentioned herein or elsewhere. Optionally, a photodiode or phototransistor may provide a feedback or input signal for the automatic brightness adjustment or as a measurement of the impedance of the phosphor.

Figure 30:
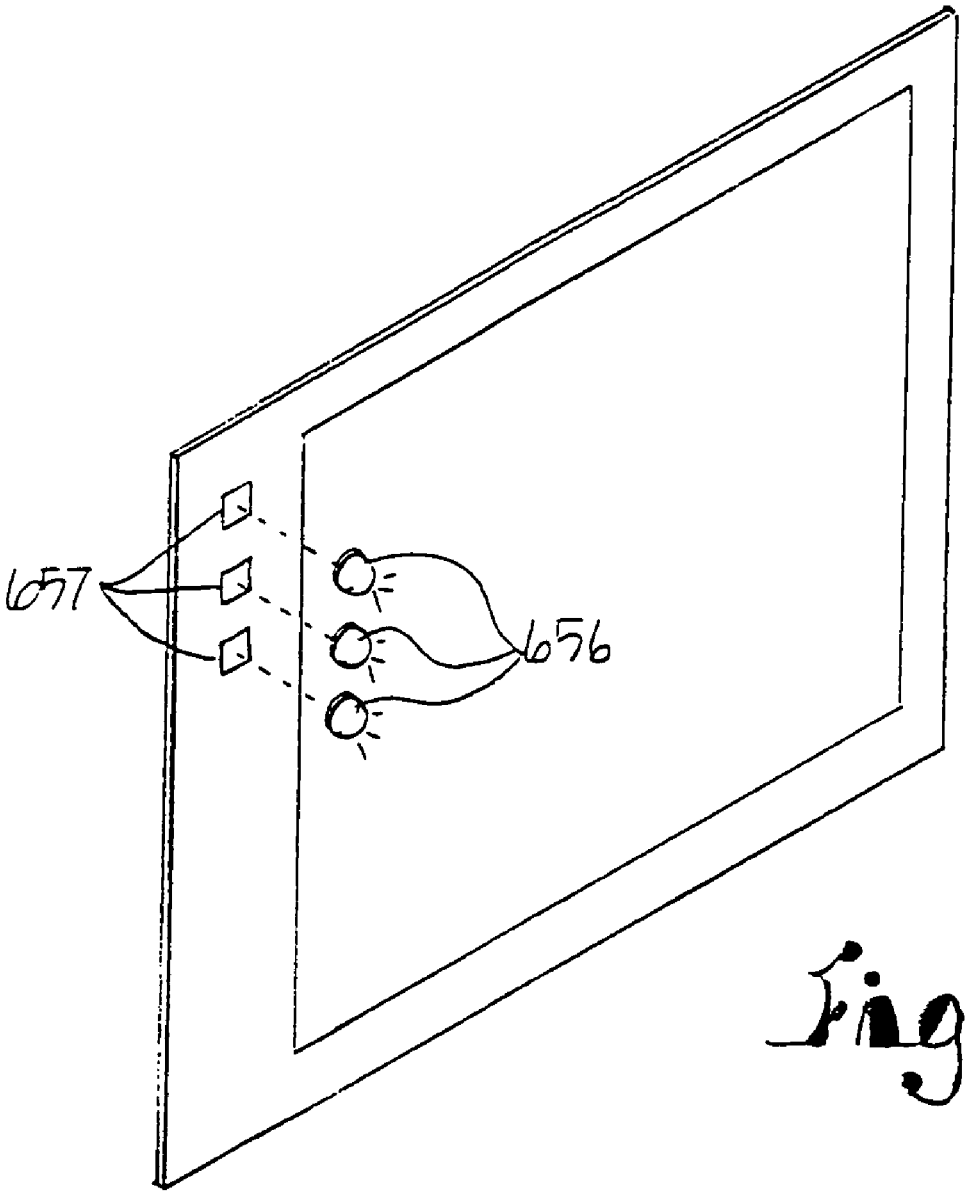
FIG. 30 is a perspective view of the electroluminescent sheet with photodiodes in accordance with the present invention.

As illustrated in FIG. 30, one or more a photodiodes 656 may be placed in the housing 650 against special small control areas 657 of EL phosphors on the electroluminescent sheet 660 outside of the work area. The photodiode is generally connected to the driver or controller. For color sheets, there should be control areas for each color. Impedance of the phosphor of the sub pixel can be used because the phosphor's efficiency does not change significantly. As a result, its impedance increases with time of use. This phenomenon can be used for an automatic brightness adjustment. For example, during the duration of one frame, the maximum voltage is applied to all vertical buses. The current through each bus is inversely proportional to the impedance of this sub pixel. This information is stored in a memory and can be used for the automatic brightness adjustment. The described process is only one of many available brightness adjustment systems. The type of system used will depend on the desired level of precision.

Air Evacuation

Figure 27:
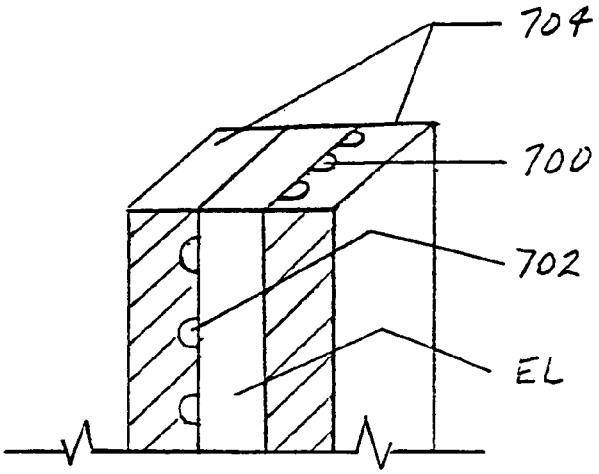
FIG. 27 is a partial, perspective view showing grooves in the electrodes for air evacuation.
Figure 28:
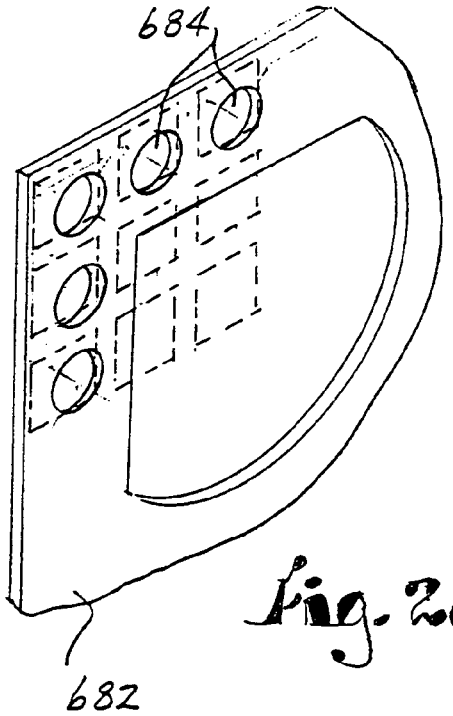
FIG. 28 is a perspective view of the separating sheet with openings.
Figure 29:
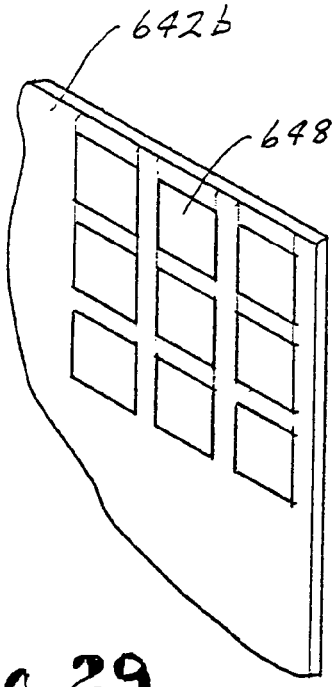
FIG. 29 is a perspective view of a rear pixeled electrode.

One or both electrodes or the electroluminescent sheet 760 can have multiple grooves, channels or holes of any shape and pattern configuration for better evacuation of the air from the envelope as shown in FIG. 27. Location of sets of grooves 700, 702 is preferably between segments of each of electrodes 704, first or second or both. Surfaces of the envelope can have similar grooves, channels or holes on their inner side. It is noted that, whereas the prior art provided an electroluminescent sheet wherein the phosphor layer is joined to both electrodes which are comparatively expensive compared to the phosphor layer, under the present invention, the sheet comprises a phosphor layer such as sheet 60 that is not joined to any electrode and can be removed from the housing and replaced without removing the electrodes or alternatively the phosphor layer of sheet 560 includes a single comparatively non expensive foil joined thereto that can be inexpensively replaced with the phosphor portion of the sheet 560. Consequently, in accordance with the invention, the term sheet as used herein preferably means a phosphor layer with no attached electrode or such a sheet with a single attached and disposable electrode.

Grooves on the viewing side can be used for improvement of the viewing angle and uniformity of emitted light. For this purpose, grooves should have a special shape.

It is to be understood that while certain forms of this invention have been illustrated and described, it is not limited thereto, except insofar as such limitations are included in the following claims and allowable equivalents thereof.

Having thus described the invention, what is claimed as new and desired to be secured by Letters Patent is as follows:

1. An electroluminescent apparatus comprising:

a housing which may be opened and closed and having front and rear panels, said front panel associated with a first electrode and said rear panel associated with a second electrode, at least one of said panels and associated electrode being transparent;

a replaceable electroluminescent sheet held between the electrodes when the housing is closed, whereby said sheet may be removed from between said electrodes and replaced when the housing is open;

a flexible membrane within said housing spaced from one of said panels to define a chamber;

structure in fluid communication with the housing for pressurizing the chamber to shift the membrane and thereby create closer physical contact between the electrodes and electroluminescent sheet; and said membrane being transparent.

2. An electroluminescent apparatus comprising:

a housing which may be opened and closed and having front and rear panels, said front panel associated with a first electrode and said rear panel associated with a second electrode, at least one of said panels and associated electrode being transparent;

a replaceable electroluminescent sheet held between the electrodes when the housing is closed, whereby said sheet may be removed from between said electrodes and replaced when the housing is open;

said housing further comprising a compressing structure for providing closer physical contact between the electrodes and electroluminescent sheet;

said compressing structure comprising an inflatable support; and said support being transparent.

3. The apparatus according to claim 2 wherein said compressing structure comprises a flexible, compressible material.

4. The apparatus according to claim 2 wherein each said first and second electrodes comprises a plurality of parallel elongated electrodes coupled to an electronic driver, presenting a dot-matrix display.

5. The apparatus according to claim 4 wherein said driver comprises a cathode ray tube and a plurality of independent anodes.

6. An electroluminescent apparatus comprising:

a housing which may be opened and closed and having front and rear panels, said front panel associated with a first electrode and said rear panel associated with a second electrode, at least one of said panels and its associated electrode being transparent, a replaceable electroluminescent element compressed between the electrodes when the housing is closed and when open may be removed from between said electrodes and replaced, said second electrode having a pixelated surface and each pixel having electrical access from a side adjacent the rear panel, and a controller electronically connected to said second electrode for selectively activating pixels of said electroluminescent element.

7. The apparatus according to claim 6 wherein said replaceable electroluminescent element has an electroluminescent phosphor impregnated therein.

8. The apparatus according to claim 6 wherein at least one of said electroluminescent element, said first electrode and said second electrode are flexible.

9. The apparatus according to claim 6 wherein said front panel is mechanically secured to said rear panel thereby compressing said electroluminescent element between said electrodes.

10. The apparatus according to claim 6 wherein said housing is provided with a hinge operably connected between said front and rear panels for removable replacement of said electroluminescent element when said housing is opened and providing compression of said electroluminescent element between said electrodes when said housing is closed.

11. The apparatus according to claim 6 further comprising alignment pegs associated with one of said front and rear panels, and alignment receivers in said electroluminescent element receiving said alignment pegs whereby said element is aligned with said electrodes.

12. The apparatus according to claim 6 wherein said housing further comprises a locking mechanism securing said housing in a closed condition thereby providing compression of said electroluminescent element between said electrodes.

13. The apparatus according to claim 6 wherein said electroluminescent element is configured with a plurality of tiles.

14. The apparatus according to claim 6 wherein at least one of said electrodes is configured to form a plurality of pixels in cooperation with the other of said electrodes and further comprising a controller for maintaining the brightness of each pixel of the electroluminescent element at a respective selected level.

15. The apparatus according to claim 6 wherein at least one of said electrodes has passages therein for evacuation of air.

16. The apparatus according to claim 6 wherein said controller is selectively coupled to said pixelated electrode surface through an insulating sheet having plural openings corresponding to associated pixels of said pixelated electrode by a plurality of contact members for ensuring electrical contact through said openings.

17. The apparatus according to claim 6 wherein each of said first and second electrodes is comprised of a plurality of parallel elongated electrode conductors, each electrode conductor being coupled to an electronic driver, thereby presenting a dot-matrix display.

18. The apparatus according to claim 6 wherein the electroluminescent element is a dot-matrix display including additional areas of electroluminescent materials used for each color and further comprising for each area a respective photodiode enclosed by said housing and in electrical communication with said driver.

19. The apparatus according to claim 6 wherein one of said electrodes includes a transparent electrode formed from thin parallel conductive wires which are held by at least one transparent film with said wires being selectively activated simultaneously, in selected groups, or separately.

20. The apparatus according to claim 6 further comprising a multi-color filter, whereby said electroluminescent apparatus provides a color display.

21. The apparatus according to claim 6 wherein:

said first electrode includes a plurality of parallel, vertically extending first electrode conductors;

said second electrode includes a plurality of parallel, transversely extending second electrode conductors perpendicular to said first electrode conductors; and a matrix driver is coupled to said first and second electrode conductors and selectively activates said first and second electrode conductors to form a dot- matrix display.

22. An electroluminescent apparatus comprising:

a housing which may be opened and closed and having front and rear panels, said front panel associated with a first electrode and said rear panel associated with a second electrode, at least one of said panels and associated electrode being transparent;

a replaceable electroluminescent element compressed between the electrodes when the housing is closed, said panels and said electrodes cooperating with said electroluminescent element in such a manner that said element may be removed from between said electrodes and replaced when the housing is open; and wherein said second electrode has a pixelated surface forming a plurality of pixels, each pixel having electrical access from a side proximate the rear panel, and a controller electronically coupled to said second electrode for selectively activating individual pixels of said electroluminescent element.

* * * * *